United States Patent [19]

Milgram et al.

[11] 4,131,397

[45] Dec. 26, 1978

[54] PUMPS

[75] Inventors: Jerome H. Milgram, Cambridge, Mass.; Vance S. Bartoo, Sommerville, N.J.; Burdett H. O'Connor, Marblehead, Mass.

[73] Assignee: Offshore Devices Inc., Peabody, Mass.

[21] Appl. No.: 787,383

[22] Filed: Apr. 14, 1977

[51] Int. Cl.[2] ..... F04B 17/00

[52] U.S. Cl. ..... 417/404; 417/469; 91/216 B

[58] Field of Search ..... 417/395, 397, 403, 404, 417/469; 91/216 B; 92/100

[56] References Cited

U.S. PATENT DOCUMENTS

| | | | |
|---|---|---|---|
| 2,260,306 | 10/1941 | Ferguson | 417/395 |
| 2,307,566 | 1/1943 | Browne | 417/395 |
| 2,619,038 | 11/1952 | Davidson | 91/216 B |
| 3,477,345 | 11/1969 | Johnson | 91/216 B |
| 3,713,755 | 1/1973 | Scheffer | 417/469 |
| 4,008,984 | 2/1977 | Scholle | 417/395 |
| 4,019,838 | 4/1977 | Fluck | 417/404 |

FOREIGN PATENT DOCUMENTS

| | | | |
|---|---|---|---|
| 1213304 | 3/1960 | France | 417/397 |

*Primary Examiner*—C. J. Husar
*Attorney, Agent, or Firm*—Maurice R. Boiteau

[57] ABSTRACT

There is disclosed in the present application a double acting diaphragm pump including a two part hollow housing which defines two pumping chambers, one on each side of the diaphragm. A pumping stroke is imparted to the diaphragm by means of a hydraulic actuator contained within the housing and including a cylinder connected to the diaphragm and supplied with hydraulic fluid through a hollow connector which also clamps the two parts of the housing together on the margin of the diaphragm.

8 Claims, 2 Drawing Figures

PUMPS

Figure 1:
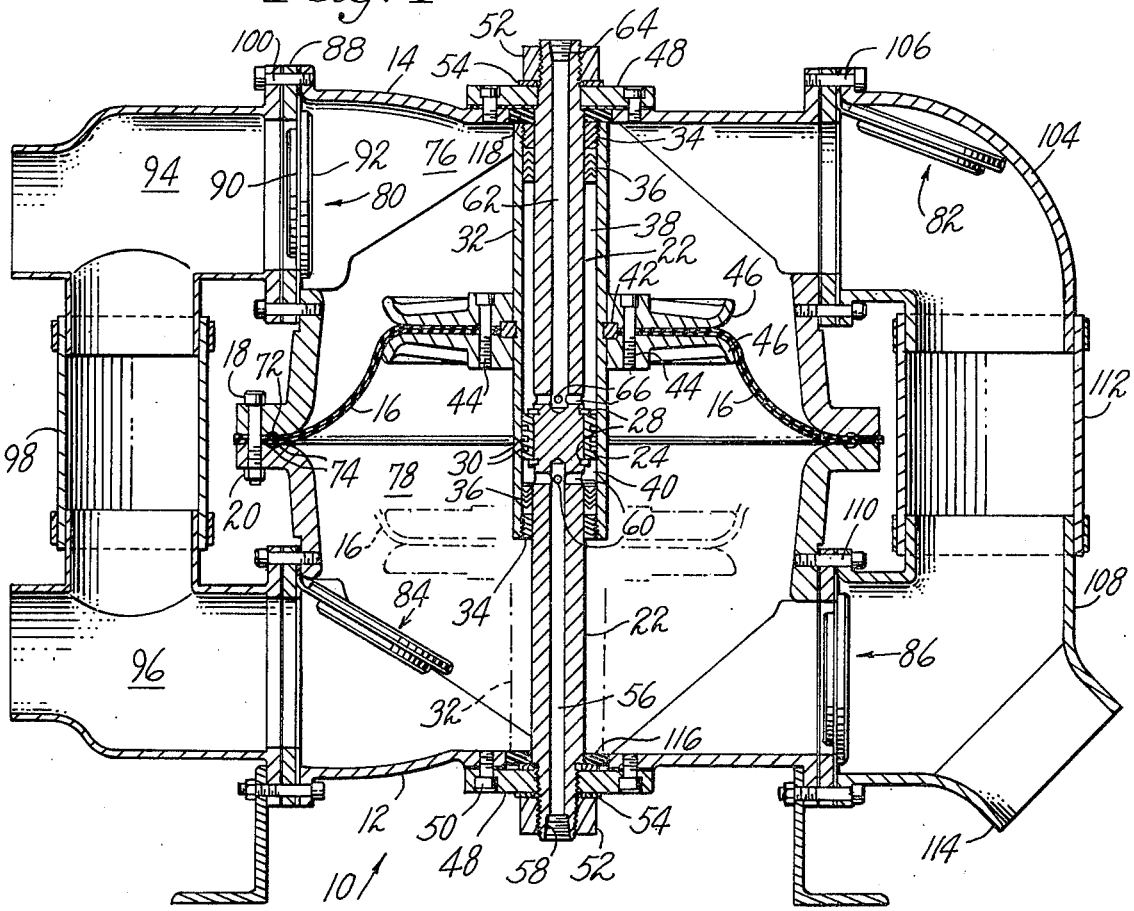

The present invention relates generally to improvements in high capacity pumps and more particularly to such pumps which are operable at sea by pressurized hydraulic fluid connected by flexible hoses to remote hydraulic power sources usually mounted aboard ship.

Recovery of oil spills at sea creates several difficulties in the choice of pumps to be used for raising the oil into separation containers aboard ship. A first problem is that the pump must frequently be handled under difficult conditions and is therefore preferably light in weight at the same time that it must have a high capacity thus requiring a high ratio of capacity to weight. Some pumps are so shaped with projections, for example, that there is an increased likelihood of damage under the difficult handling conditions often prevalent at sea. Another problem occurs when certain types of pumps are used for raising the oil to separation tanks and in so doing break up the oil into small droplets or globules which become emulsified in the water which is frequently present and thereafter requires considerable periods of time and large separation tanks to become separated from the water. Still another problem arises from the fact that oil spill recovery pumps are frequently employed in environments including foreign objects floating upon the water and that it is impractical to screen out some of these objects from suction hoses connected to the pumps. The passage of foreign objects into many types of pumps causes either clogging or jamming and serious consequent damage. Additionally, some pump designs are particularly difficult to disassemble for repairs and to reassemble under conditions existing at oil spill sites.

Still another difficulty which arises because of the fact that the pump is to be used at sea is that it is often impractical or dangerous to drive the pump with conventional prime movers such as electrical motors and internal combustion engines. A preferred power source under these conditions is pressurized hydraulic fluid from a ship borne power unit.

It is accordingly an object of the present invention to provide a pump having a relatively light weight when compared to its capacity.

Another object is a pump which is effective for moving oil without causing it to break up into globules and becoming emulsified in water.

A related object is to provide a pump which can withstand the passage of relatively large foreign objects without being damaged or otherwise interrupting the flow of fluid.

Still another related object is a pump construction which, when clogging or damage occurs, permits quick and easy access to the interior for inspection, removal of obstruction and repairs.

The foregoing objects are achieved according to the present invention by a double-acting, hydraulically actuated diaphragm pump including a two part housing defining two pumping chambers one on each side of the diaphragm. According to a feature of the invention, the two parts of the housing are clamped together by a central tubular connector upon which a stationary piston is mounted. The tube is pierced radially to provide ports on each side of the piston through which pressurized hydraulic fluid is admitted into a cylinder surrounding the piston and connected to the diaphragm to impart a pumping action to the diaphragm. Thus, by introducing pressurized fluid alternately through one port and the other on each side of the piston, the cylinder is given a reciprocating motion along the length of the tubular connector.

According to another feature of the invention, the pump is substantially free of projections, which could readily be damaged and cause serious inconvenient delays in oil spill recoveries. This feature is incorporated into the present pump by enclosing the actuating mechanism within the housing and thus requiring only that inlet and outlet hoses and hydraulic fluid supply conduits be connected to the pump.

Figure 2:
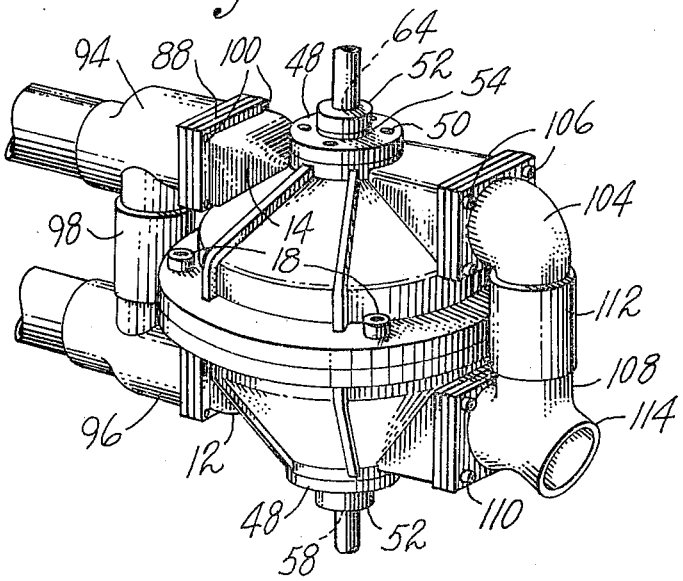

The foregoing objects and features of the present invention, together with many advantages to be derived from its use, will be more fully understood from a detailed description of an illustrative embodiment taken in connection with the accompanying drawings in which:

FIG. 1 is a view in longitudinal cross-section of a pump according to the present invention; and FIG. 2 is a view in perspective showing the exterior of the pump.

Turning now to the drawings, there is shown a pump indicated generally at 10 and comprising a two part housing preferably of cast aluminum. The housing parts which are mirror images of one another are in effect halves 12 and 14 and are clamped together at their edges on the margin of a diaphragm 16. The clamping force is provided partly by four screws, one of which is shown at 18 passing through perforations in the housing halves and in the diaphragm and into engagement with a nut 20. Cooperating with the screws 18 in clamping the housing halves 12 and 14 together, is a central connector 22 which not only reinforces the central area of the housing halves but is also formed with tubular ends to provide conduits for pressurized hydraulic fluid for actuating the pump. There is mounted on the connector 22 near the mid point of its length a piston 24 secured against longitudinal motion along the connector by being mounted between snap rings 28 which enter appropriate grooves in the connector. The piston 24 is fitted with a set of rings 30 to provide a sliding seal with the interior of a cylinder 32 which receives a hydraulically powered reciprocating motion along the length of the connector to impart a pumping action to the diaphragm 16. At each end, the cylinder 32 is fitted with a closure 34 and a seal 36 to provide upper and lower chambers 38 and 40 respectively within the cylinder above and below the piston 24, which are alternately filled with hydraulic fluid and exhausted to impart motion to the cylinder 32 as will later be explained. The cylinder 32 is grooved to receive a two-part circular key 42 clamped by screws 44 between a pair of circular stiffening plates 46 which also sandwich the central portion of the diaphragm 16.

The connector 22 is secured at its ends in a pair of adapter caps 48 each fastened by screws 50 to one of the housing halves 12 and 14. At each end of the connector 22, there is for this purpose a nut 52 and a washer 54, the nut engaging threads on a reduced end portion of the connector. Tightening of the two nuts 52 applies a clamping force to the two halves 12 and 14 of the housing. The lower portion of the connector 22 is formed with an interior passage 58 terminating in a pipe-tapped socket 68 adapted to receive an appropriate hydraulic fitting for connecting the passage 56 to a source of pressurized fluid. The passage 56 is in communication with the lower chamber 40 through radial ports 60. Similarly, the upper portion of the connector 22 is formed with a passage 62 terminating in a tapped socket 64 for connecting the passage 62 to the pressurized fluid source. The passage 62 is in communication with the chamber 38 through radial ports 66. Reciprocation of the cylinder 32 to impart the pumping action to the diaphragm 16 is accomplished by alternately filling and exhausting the chambers 38 and 40 with hydraulic fluid through appropriate valves and other controls, forming no part of the present invention, which regulate the flow rate and quantity of hydraulic fluid during each half cycle.

In order to assist in retaining the diaphragm 16 between the housing halves 12 and 14, the diaphragm is formed with an integral annular bead 72 which fits appropriate grooves 74 in the two housing halves. In the event that the pump is damaged or otherwise rendered inoperative, it may be quickly disassembled simply by freeing the connector 22 by removing the nuts 52 and by removing the four screws 18.

The flow of liquid being pumped into and out of upper and lower pumping chambers 76 and 78 is controlled by means of flapper valves to cause flow in both chambers from left to right as seen in FIG. 1. Thus, entry to the upper chamber 76 is through a flapper valve 80 and exit through an outlet valve 82. For the lower chamber 78, there are provided inlet and outlet valves 84 and 86 respectively. Each of the valves 80, 82, 84 and 86 is of similar construction and comprises as shown in detail for the valve 80, a seat plate 88, a sheet of rubber or similar material forming a seal 90 and a stiffener or reinforcement 92 fastened to the central portion of the seal 90.

It has been found that a high flow rate of a mixture of oil and water tends to cause the emulsification of the oil in the water with consequently long periods of time necessary for the separation of the oil from the water. In order to avoid the emulsification and also to avoid the need for very large inlet hoses in view of the capacity of the pump, two smaller inlet hoses are employed and the hoses are interconnected at the inlets of the two pumping chambers. For this purpose, there are provided at the inlet to the upper and lower chambers respectively Tee fittings 94 and 96 interconnected by a flexible sleeve 98. The Tee fittings 94 and 96 are secured to the housing halves by screws such as the screw 100 which passes through appropriate perforations in flanges of the fitting and of the housing halves 12 and 14, the screws 100 also performing the function of securing the seat plate 88 to the housing half. In use, an inlet hose is connected to the open end of each of the Tee fittings 94 and 96.

At the outlet end of the pump 10, provision is made to join the streams from both pumping chambers 76 and 78 to a single outlet hose. For this purpose, an elbow 104 is secured by means of screws 106 to the housing half 14 and a Y fitting 108 is secured to the housing half 12 by screws 110. A flexible sleeve 112 interconnects the elbow and the Y fitting 108 and an outlet hose (not shown) generally employed for conducting the pumped fluid to a separation tank, is connected to the open end 114 of the Y fitting.

The action of the pump 10 will be more fully understood from the following description of an operating cycle starting from the condition depicted in solid lines in FIG. 1. At this time pressurized hydraulic fluid is introduced into the lower chamber 40 of the cylinder 32 through the passage 56 and the ports 60 while the upper chamber 38 is exhausted of fluid through the ports 66 and the passage 62. Movement of hydraulic fluid into the chamber 40 and out of the chamber 38 causes the cylinder 32 to descend to the position depicted in dashed lines in FIG. 1, bringing with it the plates 46 and the diaphragm 16. Pressure applied by the diaphragm to the liquid in the chamber 78 causes the inlet valve 84 to close and the outlet valve 86 to open thus forcing the liquid which has been in the chamber to flow out through the outlet valve and to the open end 114 of the Y fitting 108. While liquid is being forced out of the lower chamber 78, the downward motion of the diaphragm 16 creates a suction in the upper chamber 76 which causes the inlet valve 80 to open and the outlet valve 82 to close, thereby admitting liquid from the hoses connected to the Tee fittings 94 and 96, into the upper chamber. Liquid continues to enter the upper chamber 76 and to be forced out of the lower chamber 78 until the cylinder 32 reaches the lower end of its travel when it abuts a shock absorbing rubber washer 116.

From the lower end of the travel of the cylinder 32, its direction of motion is reversed by pressurized hydraulic fluid being introduced into the upper chamber 38 of the cylinder through the passage 62 and the ports 66, while the lower chamber 40 is exhausted of fluid through the ports 60 and the passage 56. Movement of fluid out of the chamber 40 and into the chamber 38 causes the cylinder 32 to rise toward the position depicted in solid lines in FIG. 1. The central portion of the diaphragm 16 is thereby raised, applying pressure to the liquid in the upper pumping chamber 76 and causing closure of the inlet valve 80 and opening of the outlet valve 82, thus forcing the liquid out of the chamber 76 toward the open end 114. At the same time, as the lower pumping chamber 78 is expanded, a suction is created which causes the inlet valve 84 to open and the outlet valve 86 to close, thereby admitting liquid from the Tee fitting 96 into the lower chamber 78. The upward movement of the cylinder 32 terminates when the upper end of the cylinder abuts a shock absorbing rubber washer 118. The motion of the cylinder 32 is then again reversed under the precise control of an external regulator which, as already pointed out, forms no part of the present invention.

In order to prevent the jamming of foreign objects between the plates 46 and the interior of the housing halves 12 and 14, the minimum distance between the plates and the nearest surface of the housing is made greater than the diameter of the openings in the inlet and outlet valves 80, 82, 84 and 86. Accordingly, clearance is provided between the plates and the housing interior for any foreign objects which may enter the pumping chamber. While the length of the pumping stroke yields excellent overall efficiency and a relatively large output per operating cycle, the freedom from jamming on foreign objects entering the pumping chambers is an important advantage of the present design in view of the frequency with which such objects are encountered in the normal environment in which the pump is to be employed.

Having thus disclosed our invention, what we claim as new and desire to secure by Letters Patent of the United States is:

1. A pump comprising a housing and a single diaphragm together defining a pumping chamber, means including a set of inlet and outlet valves for controlling the passage of liquid into and out of the chamber, and hydraulically actuated means contained within the housing for imparting a pumping motion to the diaphragm and a tubular connector arranged to clamp the housing on the margin of the diaphragm and formed with a conduit for supplying hydraulic fluid to the hydraulically actuated means.

2. A pump according to claim 1 further characterized in that the housing defines a second pumping chamber and is formed in two generally equal parts clamped together on the margin of the diaphragm, and the pump further comprises means including a second set of inlet and outlet valves for controlling the passage of liquid into and out of the second chamber.

3. A double acting diaphragm pump comprising a two part housing, a single diaphragm clamped by its margin between the two parts of the housing and hydraulically actuated means including a stationary piston and a rectilinearly reciprocated cylinder contained within the housing, slidable over the piston and coupled to the diaphragm for imparting a pumping motion to the diaphragm.

4. A pump according to claim 3 further comprising a tubular connector mounted within the housing for clamping the two parts together on the margin of the diaphragm and formed with conduits for directing hydraulic fluid to the hydraulically actuated means.

5. A pump comprising a housing and a diaphragm together defining a pumping chamber, means including a set of inlet and outlet valves for controlling the passage of liquid into and out of the chamber, and hydraulically actuated means contained within the housing for imparting a pumping motion to the diaphragm and including a tubular connector arranged to clamp the housing on the margin of the diaphragm, a piston fixedly mounted on the connector and a cylinder coupled to the diaphragm and slidable over the piston.

6. A pump comprising a housing and a diaphragm together defining a pair of pumping chambers, the housing being formed in two generally equal parts clamped together on the margin of the diaphragm, means including two sets of inlet and outlet valves one for controlling the passage of liquid into and out of each chamber, hydraulically actuated means contained within the housing for imparting a pumping motion to the diaphragm, and a tubular connector mounted to apply a force bringing the housing parts together for clamping them on the margin of the diaphragm and formed with separate conduits for directing hydraulic fluid to the hydraulically actuated means.

7. A pump according to claim 6 further characterized in that the hydraulically actuated means comprises a piston fixedly mounted on the connector and a cylinder coupled to the diaphragm and slidable over the piston along the length of the connector.

8. A double acting diaphragm pump comprising a two part housing, a diaphragm clamped by its margin between the two parts of the housing, hydraulically actuated means including a rectilinearly reciprocated cylinder contained within the housing and coupled to the diaphragm for imparting a pumping motion to the diaphragm and a tubular connector mounted within the housing for clamping the two parts together on the margin of the diaphragm and formed with conduits for directing hydraulic fluid to the hydraulically actuated means, the hydraulically actuated means including a piston fixedly mounted about the midpoint of the length of the connector, the cylinder being slidable over the piston.

* * * * *